United States Patent [19]

Graves, Jr.

[11] Patent Number: 4,768,527

[45] Date of Patent: Sep. 6, 1988

[54] TOBACCO MATERIAL PROCESSING

[75] Inventor: William H. Graves, Jr., Pfafftown, N.C.

[73] Assignee: R. J. Reynolds Tobacco Company, Winston-Salem, N.C.

[21] Appl. No.: 6,204

[22] Filed: Jan. 23, 1987

[51] Int. Cl.[4] ..... A24B 3/14

[52] U.S. Cl. ..... 131/375; 131/353; 131/358; 131/360; 131/364

[58] Field of Search ..... 131/375, 353, 358, 360, 131/364

[56] References Cited

U.S. PATENT DOCUMENTS

| | | | |
|---|---|---|---|
| 1,016,844 | 2/1912 | Moonelis . | |
| 1,068,403 | 7/1913 | Maier . | |
| 2,433,877 | 1/1948 | Wells et al. . | |
| 2,592,554 | 4/1952 | Frankenburg . | |
| 2,708,175 | 5/1955 | Samfield et al. . | |
| 2,734,509 | 2/1956 | Jurgensen, Jr. . | |
| 2,734,513 | 2/1956 | Hungerford et al. . | |
| 2,769,734 | 11/1956 | Bandel . | |
| 2,845,933 | 8/1958 | Samfield et al. . | |
| 3,009,835 | 11/1961 | Samfield et al. . | |
| 3,053,259 | 9/1962 | Parmele et al. . | |
| 3,203,432 | 8/1965 | Green et al. . | |
| 3,209,763 | 10/1965 | Parmele et al. . | |
| 3,373,751 | 3/1968 | Wallberg | 131/375 |
| 3,398,754 | 8/1968 | Tughan . | |
| 3,410,279 | 11/1968 | Moshy et al. . | |
| 3,464,422 | 9/1969 | Light et al. . | |
| 3,540,456 | 11/1970 | McGlumphy et al. . | |
| 3,870,054 | 3/1975 | Arledter et al. . | |
| 3,932,081 | 1/1976 | Buchmann et al. . | |
| 4,111,211 | 9/1978 | Hincklieff et al. . | |
| 4,164,948 | 8/1979 | Beringer et al. . | |
| 4,236,538 | 12/1980 | Foster et al. . | |
| 4,325,391 | 4/1982 | Schmidt . | |
| 4,416,295 | 11/1983 | Greig et al. . | |
| 4,421,126 | 12/1983 | Gellatly . | |
| 4,497,331 | 2/1985 | Nellen . | |
| 4,510,950 | 4/1985 | Keritsis et al. . | |
| 4,542,755 | 9/1985 | Selke et al. . | |
| 4,598,721 | 7/1986 | Stiller et al. . | |
| 4,632,131 | 12/1986 | Burnett et al. . | |
| 4,646,764 | 3/1987 | Young et al. . | |

*Primary Examiner*—Vincent Millin

[57] ABSTRACT

Co-extruded smokable material in sheet-like form has a multi-layered structure. The layers are generally parallel to the major surface of the material. The material is provided by subjecting at least two filler materials to high shear agitation and co-extruding the materials while in a semi-soft state. The multi-layered material can be sized by roll treatment in order to provide a sheet-like material having a thickness of less than about 0.008 inch. In particular, the co-extruded multi-layered smokable material is subjected to compressive treatment applied perpendicularly to the major surface of the co-extruded marterial to provide a co-extruded smokable material of reduced thickness. The material so provided can be cut into small sheets (e.g., about 4 inches by 4 inches square) or into strands and employed as cut filler in the manufacture of cigarettes.

19 Claims, 3 Drawing Sheets

TOBACCO MATERIAL PROCESSING

BACKGROUND OF THE INVENTION

The present invention relates to the processing of tobacco materials and mixtures thereof with other materials, and in particular to the processing of such materials using extrusion means.

Cured tobacco leaf conventionally undergoes several processing steps prior to the time that the resulting cut filler is provided. For example, tobacco leaves are threshed in order to separate the tobacco laminae from the stem. The tobacco laminae undergo further processing resulting in cut filler, while the stems are discarded or employed in the manufacture of reclaimed tobacco products which are traditionally of relatively low quality.

The handling, threshing and storing stages of conventional tobacco leaf processing steps result in the formation of considerable amounts of wasted tobacco material. In particular, typical processing conditions cause the formation of relatively large amounts of dust and fines. Such dust and fines are of such a small size as to be of essentially no use in the manufacture of cigarettes. However, it is possible to retrieve some of the dust and fines, and employ these materials with tobacco stems in the manufacture of reclaimed tobacco materials.

Methods for providing reclaimed, reconstituted or processed tobacco materials are proposed in U.S. Pat. Nos. 1,016,844 to Moonelis; 1,068,403 to Maier; 2,708,175; 2,845,933 and 3,009,835 to Samfield et al; 2,734,509 to Jurgensen; 2,734,513 to Hungerford et al; 2,769,734 to Bandel; 3,053,259 and 3,209,763 to Parmele et al; 3,203,432 to Green et al; 3,398,754 to Tughan; 3,410,279 to Mosby et al; 3,464,422 to Herbert; 3,540,456 to McGlumphy et al; 4,325,391 to Schmidt; and 4,542,755 to Selke et al.

Methods for providing tobacco materials in lap-bonded, laminated or extruded form are proposed in U.S. Pat. Nos. 4,236,538 to Foster et al; 3,870,054 to Arledter et al; 4,416,295 to Greig et al; 4,598,721 to Stiller et al; 3,932,081 to Buchmann et al; 4,510,950 to Keritsis et al; and EPO Patent Application No. 167,370 to Demitrios et al.

It would be highly desirable to provide an efficient and effective process for providing processed tobacco materials which are co-extruded in the form of a sheet having a multi-layered structure.

SUMMARY OF THE INVENTION

The present invention relates to a smokable material which is co-extruded into a sheet-like form. The smokable material has a multi-layered structure having alternating layers of filler material. At least one of the layers of the multi-layered material includes tobacco material. The various layers are generally parallel to the major surface of the sheet-like material. Adjacent layers of the smokable material are (i) composed of diverse materials, and (ii) are arranged in an essentially contiguous relationship.

In another aspect, this invention relates to a process for providing co-extruded smokable material. In particular, two or more filler materials in a semi-soft solid state are extruded to form a smokable material having a multi-layered structure and sheet-like shape.

In a preferred aspect, filler material (optionally in the presence of binder) and having a moisture content of less than about 30 weight percent is subjected to high shear agitation. If desired, either before or after the filler material is subjected to the high shear agitation, the material is subjected to compressive treatment by passing the material, at least once, through a roller system. Separately, a diverse filler material is similarly treated (i.e., it is subjected to high shear agitation and the optional compressive treatment). Each of the treated filler materials are separately fed into an extrusion apparatus and each are subjected to extrusion conditions through separate extruders thereby providing a co-extruded smokable material having a multi-layered structure. The multi-layered material can be sized by roll treatment.

As used herein, the term "co-extrusion" relates to the simultaneous extrusion of two or more diverse semi-soft solid materials by passing the materials through an extrusion means and contacting the materials with one another to produce a continuously formed product of the desired shape.

This invention allows for the reclamation and/or processing of tobacco in an efficient and effective manner using a process which requires neither relatively large amounts of moisture nor the necessity of the additions of large amounts of binders. Of particular interest is the fact that a material which includes a blend of various filler materials can be manufactured. For example, tobaccos used in providing tobacco blends can be processed and separately fed into an extrusion apparatus. Then the various tobaccos are co-extruded to produce a smokable material having a multi-layered structure, wherein each layer is provided from one of the processed tobaccos.

The sheet-like co-extruded smokable material can be employed using techniques known in the art. For example, the processed material can be provided in a sheet-like form. If desired, the co-extruded material can be subjected to compressive treatment such as roll treatment to provide a very thin sheet-like material. The material can be dried, moistened, treated with additives, blended with other smokable materials, cut to the desired size, etc. Most preferably, the smokable material is cut into strands for use as cut filler in the manufacture of cigarettes.

DETAILED DESCRIPTION OF THE EMBODIMENTS

Figure 1:
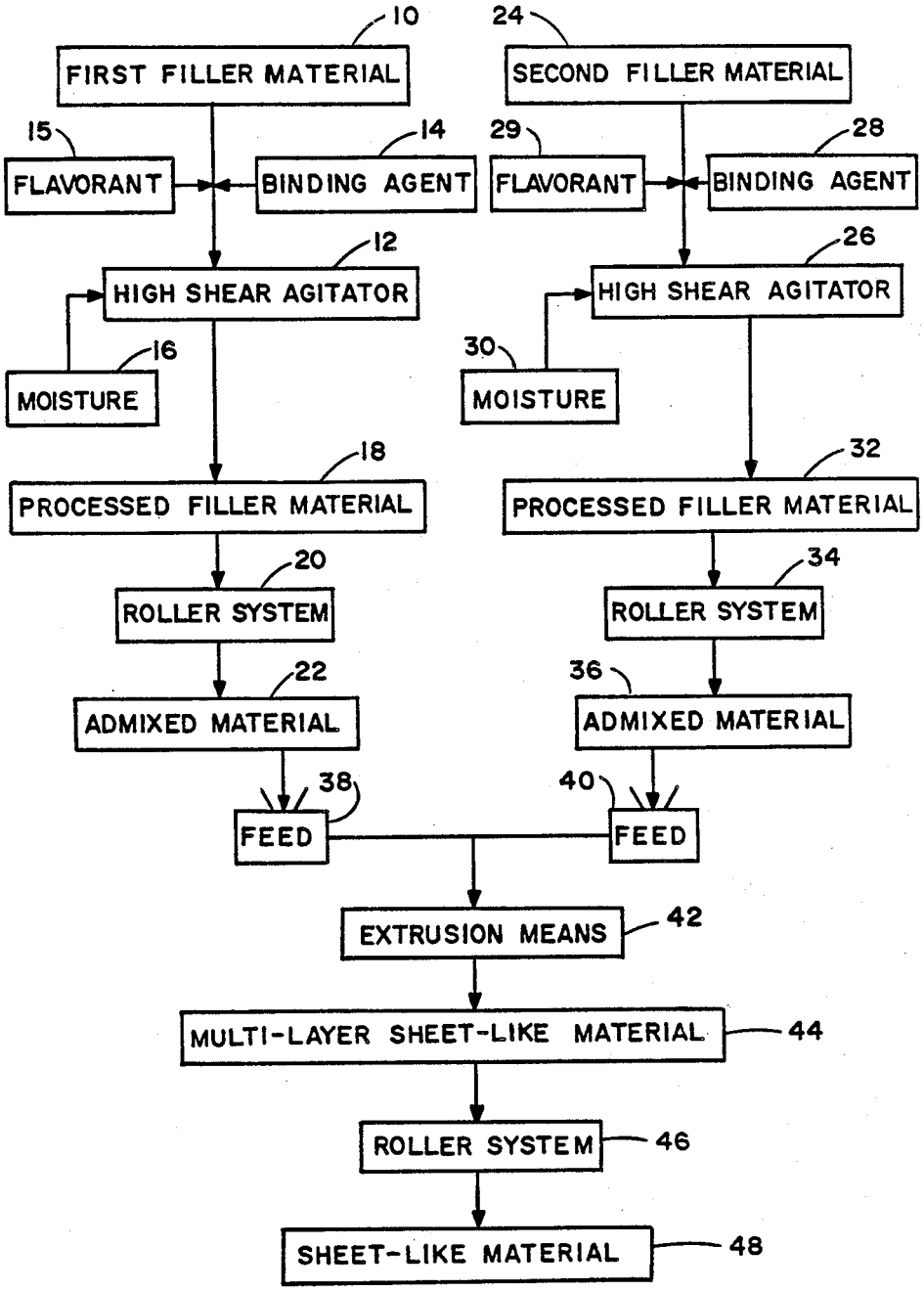
FIG. 1 is a schematic diagram of one preferred set of the processing steps for this invention.

Referring to FIG. 1, first filler material 10 is transferred into high shear agitation means 12. Optional binding agent 14, optional flavorant 15 (eg., casing and/or top dressing), and the filler material 10 are contacted with one another and one subjected to high shear agitation in the presence of moisture 16. The resulting processed filler material 18 is transferred from the high shear agitator 12 to a roller system 20 and is passed through the nip of the roller system to provide an admixed, compressed material 22. Preferably, the roll treatment provides a shearing action and an action capable of reducing the size of any tobacco stem material which may be present within the filler material. Separately, second filler material 24 is transferred to high shear agitation means 26. Optional binding agent 28, optional flavorant 29, and the filler material 24 are contacted with one another and one subjected to high shear agitation in the presence of moisture 30. The resulting processed filler material 32 is transferred from the high shear agitator 26 to a roller system 34 and is passed through the nip of the roller system to provide an admixed material 36. Each of compressed materials 22 and 36 are individually fed into separate feed zones of separate extruders 38 and 40, respectively, of extrusion means 42. The extrusion means 42 provides a mixing and forming of filler materials 22 and 36 into a multi-layer sheet-like material 44. The continuously formed material 44 is passed through a roller system 46 in order to provide a sized sheet-like material 48 of decreased thickness relative to the multi-layer material 44 which exits the die of extrusion means 42. Typically, sheet-like material 48 loses the multi-layer structure upon roll treatment by roller system 46.

Figure 2:
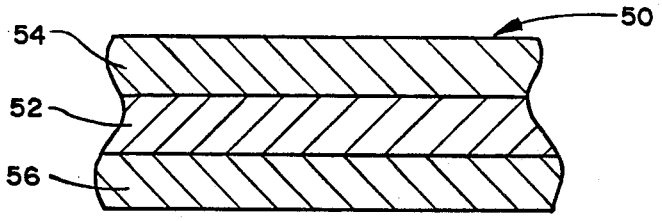
FIG. 2 is a schematic, cross-sectional view of a portion of an example of a multi-layered sheet-like co-extruded material of this invention.

Referring to FIG. 2, multi-layered sheet-like material 50 has three layers of filler material, each layer being generally parallel to the major surface of the material. The center layer 52 is positioned between adjacent outer or surface layers 54 and 56. The major surface of the material is that surface defined by the length and width of the sheet-like material. As used herein, the term "multi-layered" refers to two or more layers of different filler materials which are brought together under co-extrusion conditions and are adhered to one another, in some way. In the preferred embodiment, the adhesion between the various layers is provided by the moist nature of the filler material, the physical properties of the filler material, binding agents which may be present in the filler materials, the pressures provided to the materials during extrusion, roll treatment of the sheet which may be applied after extrusion, or a combination of such factors. Preferred multi-layered materials of this invention have from about 3 to about 9 layers. The various adjacent layers are arranged in an essentially contiguous relationship relative to one another, meaning that the successive adjacent layers are in contact along a boundary between the layers. The boundary can be abrupt especially immediately after extrusion is complete. Alternatively, an overlap or mixing of materials (i.e., between the adjacent layers) can occur along the boundary thereby providing substantial intermixing of materials of adjacent layers. Such intermixing is particularly common after roll treatment of the multi-layered material.

The adjacent layers are composed of diverse materials. For example, in referring to FIG. 2, layers 54, 52 and 56 can have an ABA or ABC configuration, depending upon whether 2 or 3 extruders are employed. In particular, center layer 52 is composed of a filler material different from each of the adjacent outer layers 54 and 56, respectively. However, layers 54 and 56 which are not adjacent to one another can be composed of similar or diverse filler materials.

Examples of suitable configurations of materials include the following. A three-layer sheet having an ABA configuration can have a fibrous tobacco stem containing material as the center layer, and the adjacent or surface layers provided from tobacco dust and/or fines and binding agent. A three layer sheet having an ABA configuration can have tobacco dust and/or fines as the center layer, and the adjacent layers provided from a fibrous tobacco stem containing material. A three-layer sheet having an ABA or ABC configuration can have carbonized or pyrolyzed materials as the center layer, and the adjacent layers provided from tobacco material(s). A three-layer sheet having an ABC configuration can have filler material for one layer provided from oriental tobacco, one layer provided from flue-cured tobacco and one layer provided from burley tobacco. A three layer sheet having an ABA or ABC configuration can have the center layer provided from flavored tobacco substitute material (optionally mixed with binding agent), and the adjacent layers provided from tobacco material(s).

For purposes of this invention, the term "filler material" relates to any material capable of providing at least a portion of the volume of a layer of the co-extruded smokable material. Examples of suitable filler materials include tobacco materials, carbonized or pyrolyzed materials, tobacco substitute materials, organic filler materials such as grains, inorganic filler materials such as clays or aluminas, or other such materials, and blends thereof. Most preferably, the filler materials useful herein are tobacco materials.

The tobacco materials useful in this invention can vary. Typically, tobacco materials include tobacco fines, tobacco dust, tobacco laminae, tobacco cut filler, scrap tobacco which is recovered from various processing stages and cigarette manufacture stages, tobacco leaf stems, tobacco stems and stalks, scraps and/or sheets of reconstituted tobacco material, rolled tobacco stems, tobacco in essentially whole leaf form, and the like, as well as combinations thereof. The sizes of the various pieces and particles of tobacco material are not particularly critical.

The term "essentially whole leaf form" is meant the entire leaf including the stem. Tobacco material in essentially whole leaf form includes cured tobacco provided from prize houses; and aged tobacco provided from bales, hogsheads and boxes. In particular, the total leaf including stem can be employed without throwing away any portion thereof. It is possible that portions of the tobacco leaf can be broken into pieces prior to the processing steps of this invention, however, such breakage need not be done purposefully as is common in conventional tobacco leaf processing. Preferably, tobacco material in essentially whole leaf form includes tobacco which is not threshed or de-stemmed. However, it may be desirable to clean or de-sand tobacco leaf using a screening technique or the like, prior to the processing steps of this invention.

Types of tobaccos useful herein most preferably include burley, flue-cured, Maryland and oriental tobaccos. Other types of tobaccos such as the rare or specialty tobaccos also can be employed.

A binding agent (i.e., binder) optionally is employed in the process of this invention and is most preferably a binding agent which is capable of being water or moisture initiated or activated. Examples of suitable binding agents include starches, modified starches, carboxymethylcellulose, sodium carboxymethylcellulose, hydroxypropylcellulose, carboxyhydroxy methylcellulose, guar gum, carragrenan gum, xanthan gum, locust bean gum, hydroxylethyl amylose, tobacco extracts, pectins, sodium alginate, a binder sold commercially as Bermocoll E270G by Berol Kemlab, and the like, as well as combinations thereof such as a blend of carboxymethylcellulose and guar gum, a blend of xanthan gum and locust bean gum, or a blend of locust bean gum and guar gum.

The amount of binding agent which is employed relative to the filler material can vary depending upon factors such as the type of binding agents, the moisture content of the filler material, the temperature at which the filler material and binding agent are subjected to the high rates of shear agitation, and other such factors. Typically, relatively low amounts of binder are employed. It is preferable to employ less than about 10 percent, more preferably less than about 5 percent, most preferably less than about 2 percent binding agent, based on the total weight of binding agent, moisture and filler material dry weight.

The filler material and binding agent are contacted and subjected to a high rate of shear agitation. The manner in which the filler material and binding agent are contacted can vary and is not particularly critical. For example, the filler material and binding agent each can be added bulk-wise to the apparatus which provides the high rate of shear agitation. Preferably the binding agent is employed in a substantially dry form when contacted with the substantially dry, divided filler material. The binding agent is dispersed (eg., mixed) with the filler material, and any moisture which may be necessary is then added to the filler material either prior to or during high shear agitation of the tobacco material.

As used herein the term "high rate of shear agitation" is meant to include that agitation which is sufficiently high in order to provide at least initiation of activation of the binding agent which is contacted with the filler material or the activation of the natural binding materials of the tobacco material (i) during a relatively short period of time, (ii) without the necessity of applying external heat in order to subject the moist tobacco material or filler material and binding agent to temperatures significantly greater than ambient temperature, and (iii) without the necessity of subjecting either the filler material and binding agent or tobacco material to moisture greater than about 30 weight percent. Typical high agitation rates exceed about 1,000 rpm, and preferably exceed about 3000 rpm as determined for a commercially available Hobart HMC-450 Mixer. The high rates of agitation can provide very rapid movement of the shearing means such as knives, blades, paddles, propellers, and the like. The time period over which the tobacco material or filler material and binding agent are subjected to the high rate of shear agitation can vary and can be as long as desired, but typically is less than about 15 minutes, more preferably between about 3 minutes and about 6 minutes. Typically the materials are subjected to the high rate of shear agitation under conditions such that the surrounding temperature is in the range from about 65° F. to about 110° F., although other temperature ranges can be employed.

It is believed that the high rate of shear agitation provides good dispersion of the binding agent relative to the filler material, and that the shear agitation provides shear energy which may provide at least the initiation of activation of the binding agent. Furthermore, the shear agitation can provide a mixing, coalescence and agglomeration of the various materials.

In addition, the high rate of shear agitation is believed to provide a breakdown of the individual particles and fibers of tobacco material. Such a breakdown is believed to provide a separation of some of the natural binding materials from the particles and fibers. In addition, it is believed that the shearing action brings out the inherent binding properties of the binding materials and makes those natural binding materials available for binding action. Thus, certain of the natural binding materials of the tobacco material exhibit binding properties for binding the various individual particles and pieces of tobacco. The natural binding materials can provide a binding action to the tobacco material in order to provide the resulting product.

As used herein the term "activation" in referring to the binding agent is meant to include the introduction of the latent adhesive properties to the binding agent as well as the introduction of the latent adhesive properties of natural binding materials of the tobacco material to make those binding materials available for binding action. Such introduction of adhesive properties can be provided by application of heat, moisture, pressure, shear energy, or the like. For example, the binding agent additive loses its substantially dry character and behaves substantially as an adhesive which is capable of adhering the filler material together. The moistened tobacco material, and the filler material and binding agent mixture which have been subjected to high shear agitation generally exhibits a formable, somewhat consistent character and can be somewhat tacky in nature.

As used herein the term "initiation" means the introduction of activation properties to the binding agent.

High rates of shear agitation can be provided using an apparatus such as a high intensity mixer, a homogenizer, a blender, or other high shear device. For example, from about 50 g to about 300 g of divided filler material, moisture and optional binding agent additive can be subjected to high shear mixing using a commercially available Waring Blender set at medium speed for about 5 minutes or high speed for about 3 minutes, while periodically scraping the sides of the mixing container with a device such as spatula in order to minimize cavitation of tobacco material and promote adequate thorough mixing. As another example, from about 1 kg to about 10 kg of filler material, moisture, and optional binding agent additive can be subjected to high shear mixing using a commercially available Hobart HMC-450 Mixer having the timer set for about 5 minutes. As yet another example, up to about 350 kg of filler material, moisture and optional binding agent can be subjected to high shear mixing using a Model No. 550/800 Disperser available for Myers Engineering, Bell, Calif.

The moisture content of the tobacco material or filler material and binding agent can vary. Typically, a low moisture content mixture requires a relatively greater amount of force in order to ultimately provide processed materials; while a high moisture content requires the undesirable and energy intensive drying processes attendant in conventional water based reconstituted tobacco processes. Typically, the filler material and binding agent mixture which is employed in the process of this invention exhibits a moisture content of at least about 12 weight percent, preferably at least about 15 weight percent; while the upper limit of the moisture content is less than about 30 weight percent, and typically is less than about 25 weight percent, based on the dry weight of the filler material, optional binding agent and total moisture. Typically, higher amounts of moisture permit the use of lower amounts of binding agent. Most preferably, the moisture content of filler material is not increased above about 18 weight percent prior to the time that the filler material and binding agent are contacted and blending (i.e., mixing) thereof is commenced. It is believed that moisture imparts a softening of material as well as providing a material having a pliability sufficiently low to allow for the utilization of a desirable force during the subsequent sheet forming process. In particular, the moist filler material is a semi-soft solid material suitable for extruding. It is desirable that the moisture content not be overly high as to require excessive drying of the resulting tobacco containing sheet-like material, or as to cause an undesirable pliability of the material and provide a sheet of relatively poor tensile strength.

Figure 3:
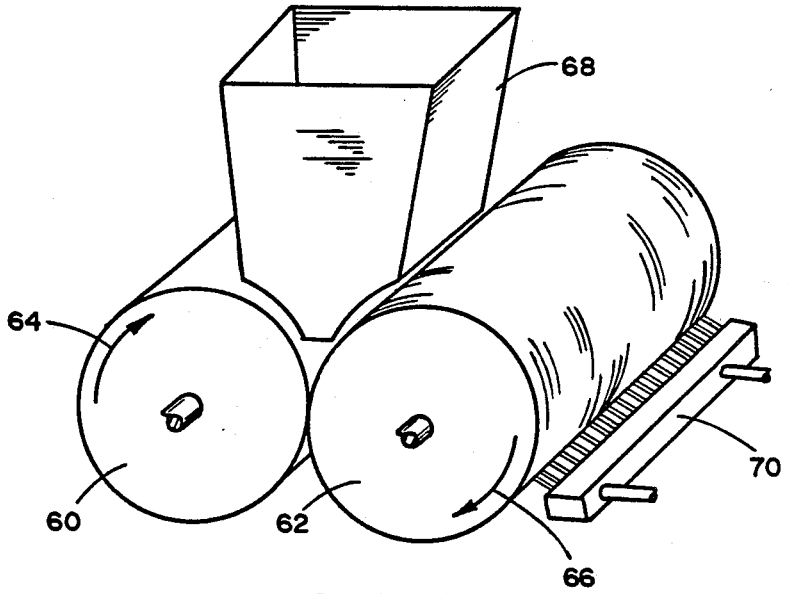
FIG. 3 is a perspective of an apparatus useful in a portion of the process of this invention.
Figure 4:
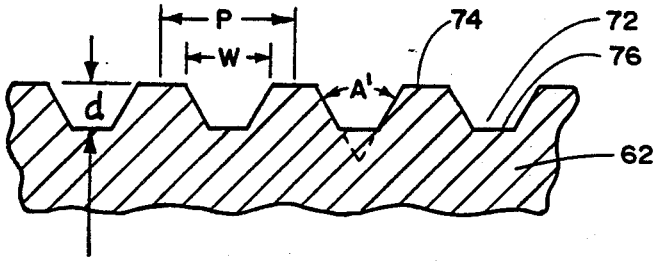
FIG. 4 is an enlarged, partial sectional view of one roller in FIG. 3 and showing a series of grooves, each groove extending circumferentially about the periphery of the roller.

FIGS. 3 and 4 illustrate an apparatus for conducting a portion of the process of this invention. The apparatus is particularly useful for providing a compressed and formed material from the moist tobacco materials or filler materials which have been subjected to the high shear agitation. The apparatus has a pressurized roller system. As used herein, the term "pressurized roller system" means two rollers in roll contact and exhibiting a nip zone pressure sufficient to provide compression of the material which passes therethrough into a more compressed form. The apparatus includes roller 60 and roller 62 in roll contact with one another. By the term, "roll contact" is meant that the two rollers aligned with roll faces essentially parallel to each other have the roll faces thereof in contact with one another for a distance along the length of each roller, and wherein each roller is capable of being rotated about the longitudinal axis of each roller. Each of rollers 60 and 62 are mounted such that the aforementioned roll contact is substantially maintained during the time that the material is passed through the nip of the roller system. Force is applied to each of the rollers using hydraulic cylinders, hydraulic pumps, compression springs, tension springs, compression rollers equipped with jack screws, or the like. Each of rollers 60 and 62 are rotated in the direction indicated by arrows 64 and 66 within the rollers. The rollers are rotated in opposite directions relative to one another in order that the material is passed through the nip of the rollers. Each of the rollers are driven using a power source (not shown) such as a variable speed motor (eg., an electric motor capable of generating from about 0.5 to about 5 horsepower) which turns the rollers by a series of drive gears (not shown). The rollers are supported to a support means such as a frame (not shown) to a chassis (not shown).

For the embodiment shown roller 60 has an essentially smooth (i.e., non-grooved) roller face; and roller 62 contains a series of grooves therein. The series extends longitudinally along the roller 62, and each groove extends about the periphery of the roller. Roller 62 is referred to as a "grooved roller."

The faces between the rollers which typically required in the process of this invention can vary, but is that force which is great enough to generate sufficient roller nip zone pressures in order to provide or form ultimately well mixed, sheared, compressed materials. That is, sufficient nip zone pressures are those sufficient to provide shearing, mixing, and forming of the material, and can be as great as is desired. Typically, forces between rollers of at least about 400, and as much as about 3,000, preferably about 600 to 1,500, pounds per linear inch, are great enough to generate sufficient nip zone pressures. Typically, the rollers are constructed of a metal material such as hardened carbon steel or hardened alloy steel, or other material sufficient to withstand the compression.

The sizes of the rollers can vary. Typically roller diameters range from about 3 inches to about 36 inches, preferably about 6 inches to about 8 inches; while roller lengths range from about 4 inches to about 24 inches. The diameters of the two rollers forming the roller system can be equal, or the diameters can differ. Typical rotation roller speeds range from about 10 rpm to about 270 rpm.

Operation of the apparatus involves feeding the material by hopper 68 into the feed zone or nip zone of the rollers 60 and 62. The material passes through the pressurized roller system, and is mixed and performed into a macerated and compressed material having some characteristics of sheet-like material. The material exiting the roller system can have a tendency to stick to the rollers, and the material can be removed from the roller face (particularly grooved roller 62) by scrape 70. Scrape 70 can be a series of needles which extend into the grooves of grooved roller 62, a comb-like configuration, a corrugated metal sheet, metal finger-like materials, or a knife-like means such as a doctor blade, positioned against the face of the roller so as to remove (i.e., scrape) the material from the face of the roller.

FIG. 4 illustrates a portion of roller 62. The series of grooves 72 are positioned along roller 62, and each groove has a top portion 64 (i.e., towards the outer surface of the roller face) and a bottom portion 76 (i.e., towards the inner portion of the roller). The grooved roller can provide shredding, tearing, forming, mixing or blending action to the material which is passed through the roller system. The series of grooves extends longitudinally along roller 62. Each groove 72 completely circumscribes roller 52. Preferably, each groove has a shape substantially similar to the other grooves which extend along the roller. Preferably, the grooves each circumscribe the roller transversely relative to the longitudinal axis of the roller. Top portion 74 is flattened and typically ranges in width from about 0.010 inch to about 0.015 inch. Generally, the flattened top portion 74 is narrow enough so as to not require excessive force in order to maintain roller contact within the pressurized roller system; while flattened top portion 74 is wide enough as to not deform to a substantial extent under typical nip zone pressures. Bottom portion 76 can be rounded or flattened (as illustrated in FIG. 4). When flattened, bottom portion 76 typically ranges in width from about 0.003 inch to about 0.007 inch. Generally, bottom portion 76 is narrow enough so as to provide sufficient mixing action to the material. Flattened bottom portion 76 is wide enough so as to permit the release of material from the surface region of the roller after processing. In particular, a bottom portion 76 which is overly narrow or pointed can tend to trap material in the groove and prevent release of the material therefrom. The depth d of the groove can vary and typically ranges from about 0.008 inch to about 0.025 inch. The depth is defined as the radial distance between the bottom portion of the groove and the top portion of the groove. The greatest width w of the groove can vary and typically ranges from about 0.015 inch to about 0.040 inch. The width is defined as the lateral distance measured across the groove. The pitch p of the groove can vary and depends upon a variety of factors including the type of material which is processed, the moisture content of the material, the shape of the groove, and the like. The pitch is defined as that lateral distance from the center of top portion 74 to the center of the nearest adjacent top portion 74. Typically, a pitch of about 0.02 inch (i.e., about 1/50 inch) to about 0.06 inch (i.e., about 1.16 inch); preferably about 0.03 inch (i.e., about 1.32 inch) is useful for most applications. The shape of groove 72 can vary and depends upon a variety of factors. However, each groove has a maximum width near the surface of the roller and a minimum width near the bottom of the groove. Each groove 72 has sloped sides (i.e., non perpendicular to the roller face) and preferably each groove is generally "V" shaped. For example, pressurized roller system having a roller comprising a series of grooves each having a sloping inner edge each groove circumscribing an angle A′ of less than about 120°, can mix material suitably well; and a pressurized roller system having a roller comprising a series of grooves each having a sloping inner edge, each groove circumscribing an angle A′ of greater than about 60°, can release processed material suitably well. The preferred angle A′ ranges from about 60° to about 120°, and is most preferably about 90°.

Figure 5:
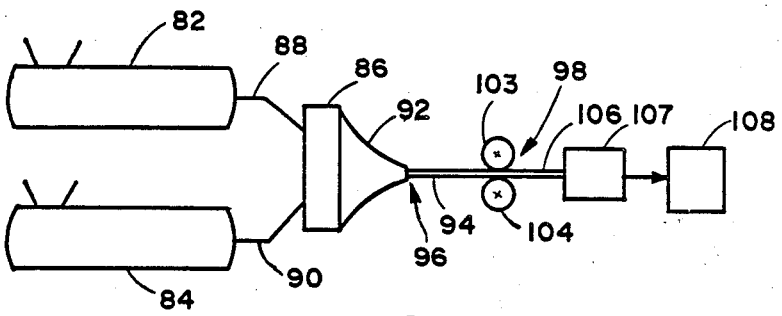
FIGS. 5 and 6 are diagrammatic illustrations of apparatus useful in a portion of the process of this invention showing the extrusion means including the die which can provide sheet form multi-layered processed material.
Figure 6:
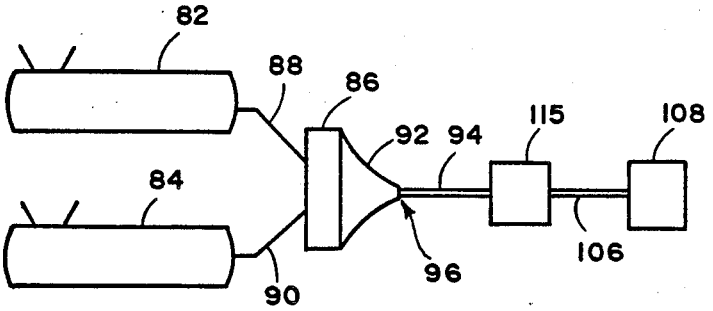

Referring to FIGS. 5 and 6, extrusion means 80 includes first extruder 82 and second extruder 84 in cooperative combination with distribution manifold 86 by means of conduits 88 and 90, respectively. The distribution manifold 86 receives the material from each of the extruders 82 and 84, provides the desired ordering of materials for a multi-layered structure, and passes the materials to a die 92 wherein the sheet-like, multi-layered material 94 formed thereby exits discharge opening 96. The multi-layered material 94 is passed through roller apparatus 98 in order to provide sheet-like sized material 102 of thickness less than multi-layered material 94. As illustrated in FIG. 5, the multi-layered material 94 which exits the discharge opening 96 is directly fed through roller apparatus 98 which includes rollers 103 and 104. The multi-layered material 106 is divided into strands or other such shape by cutting unit 107 and collected in container 108. As illustrated in FIG. 6, the multi-layered material 94 which exits the discharge opening 96 is fed through roller apparatus 115. The multi-layered material 102 is collected in container 108.

Two or more extruders are employed to provide the desired composition to the ultimate multi-layered article. For example, a multi-layered article having an ABA configuration is provided using two extruders; while a multi-layered article having an ABC or an ABCBA configuration is provided using three extruders.

Figure 7:
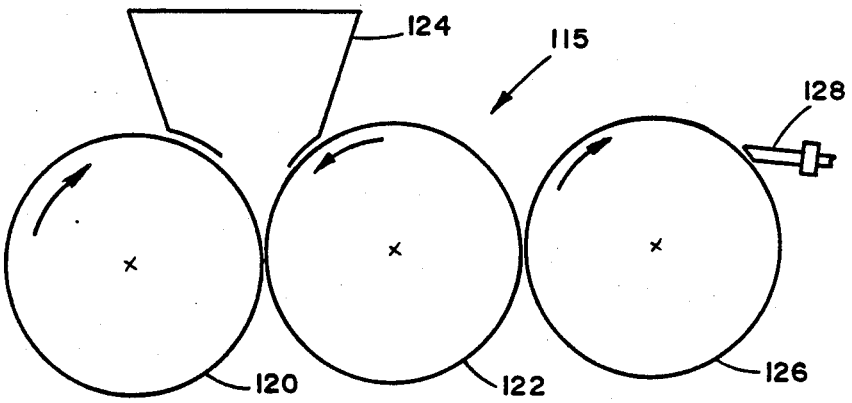
FIG. 7 is a diagrammatic illustration of an apparatus useful in a portion of the process of this invention showing three rollers which can provide sheet form material of decreased thickness.

FIG. 7 illustrates roller apparatus 115 having three rollers in horizontal alignment and positioned so as to have the ability to be moved out of roll contact. The three rollers typically have substantially smooth surfaces. First roller 120 and second roller 122 are rotated in directions opposite to one another such that previously processed tobacco material fed in hopper 124 can pass through the nip thereof. Third roller 126 is rotated in a direction opposite to second roller 122 such that processed tobacco material passes through the nip thereof. Typically, first roller 120 is rotated at about 20 rpm to about 50 rpm; second roller 122 is rotated at a greater speed than the first roller; and third roller 126 is rotated at a greater speed than the second roller. The greater rotational speed of the second roller relative to the first roller provides the tendency for co-extruded material to adhere to the second roller; and similarly the greater rotational speed of the third roller relative to the second roller provides the tendency for co-extruded material to adhere to the third roller. Material in generally sheet-like form (eg., as a sheet-like product) is removed from the surface of the third roller using scrape 128 which extends along the roller face thereof. The rollers are supported by a frame (not shown) and are rotated using a power source (not shown) and a series of drive gears (not shown).

The processed material which is provided according to the process of this invention can be provided generally in the form of a sheet. The sheet-like material exhibits good flexibility and tensile strength. Typically, the processed material in the form of a sheet exhibits a structural strength which approaches that of tobacco leaf. By the term "sheet" as used herein is meant that the material is in a form wherein the length and width thereof are substantially greater than the thickness thereof. Typically, the thickness of the sheet approximates that of tobacco leaf, cured or processed tobacco leaf, or wet reconstituted tobacco sheet product. For example, the thickness of the sheet preferably ranges from about 0.002 inch to about 0.02 inch, more preferably from about 0.002 inch to about 0.008 inch. The length and width of the sheet or strip of processed material can vary. The width of the sheet generally is determined by factors such as the extrusion die configuration, the operation and positioning of the rollers of the roller system, and the like. The sheet-like material exhibits good flexibility and tensile strength. It is most desirable to have sheet of good physical properties which is as thin as possible. The sheet can be cut as are tobacco leaf or wet formed reconstituted tobacco material (eg., in strips of about 32 cuts per inch) using various cutting devices. The tobacco material can be cased, top dressed and treated with numerous flavorants, and employed as cut filler in the manufacture of cigarettes.

The process of this invention can be employed to produce sheet-like material, which can be shredded to form cut filler of consistent composition and quality. For example, the amount of components which are fed into the extruders and extruded can be controlled to yield a resulting product having the well controlled, desired amounts of components. Of particular interest is the fact that the resulting cut filler, which can have a well controlled consistent blend of materials, can be employed in the manufacture of cigarette rods of consistent quality. For example, cut filler manufactured from sheet-like product of this invention can be employed in cigarette manufacture in order to avoid areas of high or low concentration of particular tobacco type and/or flavorant within the tobacco rod of the cigarette.

The following examples are provided in order to further illustrate various embodiments of the invention but should not be construed as limiting the scope thereof. Unless otherwise noted, all parts and percentages are by weight.

EXAMPLE 1

Sheet form tobacco material having three co-extruded layers is provided using the following procedure.

Into a Hobart HMC-450 high shear mixer equipped with stainless steel shaft and two stainless steel blades, each having lengths of about 8 inches, is placed about 4 kg of burley tobacco scrap. The scrap is tobacco dust, fines, stems and laminae recovered from tobacco processing stages. Typical individual pieces of scrap have a maximum dimension of about 0.5 inch. To the tobacco material is added 2 percent binding agent. The binding agent is 1 part guar gum and 1 part locust bean gum. Enough water is added to the tobacco scrap to provide a tobacco material having a moisture content of about 20 percent.

The burley tobacco mixture is subjected to high shear agitation by running the mixer at 3,500 rpm for about 3 minutes.

The resulting moist burley tobacco material which has been subjected to high shear agitation is processed further by compressive treatment using the roller apparatus generally illustrated in FIGS. 3 and 4.

Roller 60 is constructed from hardened steel, has a smooth surface, and has a diameter of 6 inches and a roller face having a length of 4 inches. Roller 62 has a diameter of 6 inches and is of a similar length and construction to roller 60; however, roller 62 contains grooves extending in a radial fashion about the periphery thereof. Roller 62 contains grooves in a 4 inch distance longitudinally along the roller face. The grooved portion of the roller is generally illustrated in FIG. 4. The depth d of each groove is about 0.009 inch, the pitch p of each groove is about 0.03125 inch, and the angle A' is about 60°. The top portion of each groove is flattened by a distance of about 0.008 inch, and the bottom of each groove is flattened by a distance of about 0.003 inch. The rollers both are rotated at about 35 rpm. The power source is a 1.5 horsepower electric motor having a geared drive system. Jack screws provide a pressure between the rollers of about 1,000 pounds per linear inch. The moist tobacco material is placed in hopper 68 of the apparatus, and the material is passed through the nip of rollers 60 and 62. The material so processed is collected and resembles a corrugated sheet.

The tobacco material so treated is stored in a sealed plastic bag until it is employed in further processing steps.

Separately, into the Hobart HMC-450 high shear mixer is placed 5 kg of flue-cured tobacco scrap. Enough water is added to the tobacco to provide a tobacco material having a moisture content of about 20 percent.

The flue-cured tobacco mixture is subjected to high shear agitation by running the mixer at 3,500 rpm for about 5 minutes.

The resulting moist flue-cured tobacco material which has been subjected to high shear agitation is processed further by compressive treatment using the previously described roller apparatus in a manner as previously described.

The tobacco material so treated is stored in a sealed plastic bag until it is employed in further processing steps.

The tobacco materials are co-extruded using the apparatus generally illustrated in FIG. 6.

The burley tobacco material is fed into a single screw extruder (L/D is 24/1) which is sold commercially as KL-100 One Inch Floor Model Extruder by Killion Extruders, Inc., Verona, NJ.

The flue-cured tobacco material separately is fed into a similar single screw extruder.

Each of the tobacco materials are extruded using the respective extruders distribution manifold through a die. The distribution manifold is available as Combing Adaptor Drawing No. 009-090 from Killion Extruders, Inc. The die is a 6 inch wide adjustable lip sheet die available as Sheet Die Drawing No. 013-061 from Killion Extruders, Inc. The extruders, distribution manifold and die are positioned such that the extrudate of burley tobacco material is separated into two flows. The tobacco materials are co-extruded at about 20 to about 50 pounds per hour of total extrudate delivery. The barrel temperature of each extruder during extrusion is about 110° F. (i.e., in a range from about 75° F. to about 120° F.). The extrudate exits the die and pieces of sheet-like material are collected. The pieces have widths of about 4 inches, lengths of about 4 inches to about 8 inches, and a thickness ranging from ¼ inch to about 3/16 inch. The sheet includes a center layer of flue-cured tobacco material (i.e., about 4 parts flue-cured tobacco for the sheet) and a layer of burley tobacco material (i.e., about 2.5 parts burley tobacco for each layer for the sheet) on each side of the layer of flue-cured tobacco material (i.e., generally parallel to the major surface of the layer of the flue-cured tobacco material and in a contiguous relationship thereto).

The pieces are collected and stored in a sealed plastic bag. The pieces are removed from the plastic bag, and enough moisture is added to the material to provide thereto a moisture content of about 22 to about 23 percent.

The resulting tobacco material is further processed using an apparatus generally illustrated in FIG. 7 in order to provide sized sheet.

The apparatus is a roll mill sold commercially as Kent Model 4"×8" Lab, High-Speed, 3 Roll Mill by Chas. Ross & Son Co., Hauppauge, N.Y. The apparatus comprises 3 rollers each having an essentially smooth roll face. The rollers each have a longitudinal length of 8 inches and a diameter of 4 inches. The rollers are positioned in a horizontal position with their roll faces parallel to one another. The spacing between the roll faces is proportional to the pressure applied to the rollers and to the tobacco material passing through the nip area. The sheet-like tobacco material is transferred to the hopper which feeds said material in a sheet-like fashion to the zone between the first 2 rollers. Thus, the first roller is rotated at a roll speed of 30 rpm. The second roller is rotated at a roll speed of 3 times that of the first roller (i.e., 90 rpm). The material passes between the rollers and then passes between the second and third rollers. The third roller is rotated at roll speed of 3 times the second roller (i.e., 270 rpm). The processed tobacco material (i.e., the pieces of sheet) is collected from the third roller using a doctor blade positioned along the roll face of the third roller near the extreme vertical portion of the roller. The doctor blade is extended to provide a collection tray for the product. The nip zone pressure between rollers 120 and 122 is 200 pounds per linear inch; and the nip zone pressure between rollers 122 and 126 is from 300 to 400 pounds per linear inch.

The sized pieces sheet-like material which are collected have thicknesses of about 0.004 inch to about 0.008 inch.

EXAMPLE 2

Sheet form tobacco material having three co-extruded layers is provided using the following procedure.

Into the Hobart HMC-450 high shear mixer is placed about 2 kg of burley tobacco scrap and enough water to provide a tobacco material having a moisture content of about 20 percent. The burley tobacco mixture is subjected to high shear agitation by running the mixer at 3,500 rpm for about 5 minutes.

Separately, into the Hobart HMC-450 high shear mixer is placed about 4 kg of flue-cured tobacco scrap and 2 percent binding agent. The binding agent is 1 part guar gum and 1 part locust bean gum. Enough water is added to the mixture to provide tobacco material having a moisture content of about 20 percent. The tobacco material mixture is subjected to high shear agitation by running the mixer at 3,500 rpm for about 3 minutes.

Each of the mixed tobacco materials are separately subjected to compressive treatment using the roller apparatus described in Example 1.

The tobacco materials then are extruded in the manner described in Example 1, except that the center layer is the burley tobacco material and the outer layers are the flue-cured tobacco material. A continuous sheet having a width of about 4 inches and a thickness of about 3/16 inch is provided.

The material is further processed using the apparatus generally illustrated in FIG. 7 in the manner described in Example 1. The pieces of material which are collected have thicknesses of about 0.004 inch to about 0.008 inch.

EXAMPLE 3

The materials described in Example 1 are processed as described in Example 1. However, the tobacco material forming the center layer is processed with a mixture of 1 percent ammonium bicarbonate and 1 percent citric acid. The sheet-like product exhibits an odor of ammonia.

What is claimed is:

1. A co-extruded smokable material having a sheet-like form, the smokable material comprising: a multi-layered structure having alternating layers of co-extruded filler material wherein at least one of said layers includes tobacco material; wherein (i) said layers are generally parallel to the major surface of the material, and (ii) adjacent layers are composed of diverse materials and are arranged in an essentially contiguous relationship relative to one another.

2. The material of claim 1 having three layers of filler material.

3. The material of claim 2 wherein the filler material of each of the layers is tobacco material.

4. A process for co-extruding smokable material having a sheet-like form, the process comprising co-extruding two or more filler materials in a semi-soft solid state, at least one of which layers includes tobacco material; and forming a smokable material having a multi-layered structure and a sheet-like shape.

5. The process of claim 4 whereby the filler materials so employed have a moisture content of less than about 30 weight percent.

6. The process of claim 4 whereby the filler materials so employed have a moisture content of between about 15 weight percent and about 25 weight percent.

7. The process of claim 4 whereby the sheet-like smokable material is further subjected to compressive treatment applied essentially perpendicularly to the major surface of the co-extruded material.

8. The process of claim 5 whereby the sheet-like smokable material is further subjected to compressive treatment applied essentially perpendicularly to the major surface of the co-extruded material.

9. The process of claim 7 whereby said compressive treatment is provided by passing the material through at least one roller system.

10. The process of claim 8 whereby said compressive treatment is provided by passing the material through at least one roller system.

11. The process of claim 4 whereby the filler materials are each subjected to high shear agitation prior to the co-extrusion process step.

12. A process for providing smokable material in sheet-like form, the process comprising (i) co-extruding smokable material having alternating layers of co-extruded filler material, at least one of the layers including tobacco material, such that the layers are generally parallel to the major surface of the material and the adjacent layers being composed of diverse materials and arranged in an essentially contiguous relationship relative to one another; and then (ii) subjecting the co-extruded smokable material to compressive treatment, whereby the compressive treatment is applied essentially perpendicularly to the major surface of the co-extruded smokable material.

13. The process of claim 12 whereby the filler materials are subjected to high shear agitation prior to the co-extrusion process step thereof.

14. The process of claim 12 whereby the compressive treatment is sufficient to provide a resulting sheet-like material having a thickness from about 0.008 inch to about 0.002 inch.

15. The process of claim 12 whereby the filler materials subjected to co-extrusion are tobacco materials.

16. The process of claim 4 whereby a binding agent is co-extruded with at least one of the filler materials.

17. The process of claim 12 whereby a binding agent is co-extruded with at least one of the filler materials.

18. The process of claim 11 whereby the filler materials are each subjected to high shear agitation along with a binding agent.

19. The process of claim 13 whereby the filler materials are each subjected to high shear agitation along with a binding agent.

* * * * *